US008264139B2

(12) United States Patent
Abe et al.

(10) Patent No.: US 8,264,139 B2
(45) Date of Patent: Sep. 11, 2012

(54) FLUORESCENT DISPLAY DEVICE AND MANUFACTURING METHOD THEREFOR

(75) Inventors: Keita Abe, Chiba-ken (JP); Sadao Takano, Chiba-ken (JP); Yusuke Yasuoka, Chiba-ken (JP)

(73) Assignee: Futaba Corporation, Mobara-Shi (JP)

( * ) Notice: Subject to any disclaimer, the term of this patent is extended or adjusted under 35 U.S.C. 154(b) by 348 days.

(21) Appl. No.: 12/232,276

(22) Filed: Sep. 15, 2008

(65) Prior Publication Data

US 2009/0085460 A1 Apr. 2, 2009

(30) Foreign Application Priority Data

Sep. 28, 2007 (JP) ..... 2007-254896

(51) Int. Cl.
*H01J 63/04* (2006.01)
*H01J 9/00* (2006.01)

(52) U.S. Cl. ..... 313/496; 445/58

(58) Field of Classification Search ..... 313/495–496, 313/306, 309; 445/58, 49–51
See application file for complete search history.

(56) References Cited

U.S. PATENT DOCUMENTS 4,571,523 A * 2/1986 Morimoto et al. ..... 313/497
4,835,445 A 5/1989 Watanabe et al.
5,426,342 A 6/1995 Nakamura et al.
5,614,786 A 3/1997 Nakamura et al.
5,705,097 A * 1/1998 Suzuki et al. ..... 252/514
6,078,137 A * 6/2000 Tojo et al. ..... 313/495
6,400,073 B1 * 6/2002 Mihira et al. ..... 313/495
6,525,468 B1 * 2/2003 Wada et al. ..... 313/510

FOREIGN PATENT DOCUMENTS

JP 63-159261 10/1988
JP 1-065755 3/1989
KR 10-1996-0015316 11/1996

OTHER PUBLICATIONS

Korean Office Action dated Feb. 23, 2010.

* cited by examiner

*Primary Examiner* — Anh Mai
*Assistant Examiner* — Elmito Breval
(74) *Attorney, Agent, or Firm* — Bacon & Thomas, PLLC

(57) ABSTRACT

A fluorescent display device includes a housing having with a glass substrate and a circuit board adhered to the inner surface of the glass substrate of the housing. The circuit board includes an anode formed of multiple anode conductors, control elements for controlling the anode conductors and a phosphor layer formed on the anode conductors. The fluorescent display further includes an electron source formed above the anode in the housing, from which electrons are bombarded to the phosphor layer corresponding to the anode conductors selected by the control elements so that a desired display can be obtained. An aluminum thin film with the aluminum area ratio within a range from 30 to 60% is formed on the inner surface of the glass substrate and the circuit board is fixed to the aluminum thin film via a die-bond material.

3 Claims, 9 Drawing Sheets

*FIG. 5*

| ACCELERATION [G] | Al AREA | | | | |
|---|---|---|---|---|---|
| | 30% | 40% | 50% | 60% | 75% |
| 600 | 1 | | | | |
| 700 | | | | | 3 |
| 800 | | | | | 1 |
| 900 | | | | 1 | |
| 1000 | | | | | |
| 1100 | | | | | 1 |
| 1200 | | | | | |
| 1300 | 1 | 1 | | | |
| 1400 | | 1 | 2 | 1 | |
| 1500 | | | | 2 | |
| 1600 | | | | | |
| 1700 | | | | | |
| 1800 | | | | | |
| 1900 | | | | 1 | |
| 2000 | 3 | 3 | 3 | | |
| AVERAGE ACCELERATION | 1580 | 1740 | 1760 | 1440 | 800 |

FLUORESCENT DISPLAY DEVICE AND MANUFACTURING METHOD THEREFOR

FIELD OF THE INVENTION

The present invention relates to a fluorescent display device of an active matrix driving type wherein a circuit board having multiple anode conductors arranged in a matrix form to be selected by switching elements and a phosphor layer for covering the anode conductors is formed on the inner surface of a housing and electrons from an electron source of the housing are bombarded to the phosphor layer corresponding to the anode conductors selected by the switching elements so that a desired display can be obtained; and, more particularly, to a fluorescent display device and manufacturing method thereof capable of firmly fixing the circuit board including an anode to a substrate of a housing and preventing the circuit board from being detached from the substrate.

BACKGROUND OF THE INVENTION

An example of a fluorescent display device where semiconductor chips are adhered to a glass substrate to become a single unit body in a housing is disclosed in Japanese Patent Laid-open Application No. H11-224622. Herein, the semiconductor chips mounted on the inner surface of the glass substrate forming part of the housing of the fluorescent display device and fixed thereto with paste need not be taken off for inspecting the adhered state of the semiconductor chips so that the efficiency of inspection work and productivity can be improved.

As shown in FIGS. 7 and 8, multiple slits 31 are provided at portions of a grounding wiring layer 30 where semiconductor chips are mounted, the wiring layer 30 made of aluminum being formed on a glass substrate 20. The slits 31 in FIG. 7 are formed in the X-direction, i.e. horizontal direction, and Y-direction, i.e. vertical direction, from a plane view, while the slits 31 in FIG. 8 are concentrically arranged.

Conductive paste 40 is coated on the wiring layer 30 as shown in FIG. 9A and then semiconductor chips 50 are pressed downward to spread the conductive paste 40 so that the semiconductor chips 50 are fixed to the glass substrate 20 as shown in FIG. 9B. Since the wiring layer 30 has the pattern with the slits 31 as shown in FIGS. 7 and 8, the spread shape of the conductive paste 40 can be easily inspected from the backside of the glass substrate 20 of the fluorescent display device without peeling off the semiconductor chips 50 to check whether or not the conductive paste 40 is uniformly pressed.

The multiple slits 31 formed on the aluminum wiring layer 31 on the glass substrate 20 in the fluorescent display device of JP-A-H11-224622 are just used to check whether the conductive paste 40 for electrically connecting the semiconductor chips 50 and the wiring layer 30 is uniformly pressed and evenly spread between the semiconductor chips 50 and the wiring layer 30. However, the influence of the wiring layer 30 on fixation strength between the semiconductor chips 50 and the glass substrate 20 via the conductive paste 40 is not disclosed therein.

As a result of studies on the structure for fixing semiconductor chips to a wiring layer with slits thereon such as disclosed in JP-A-H11-224622, the present inventors have found that the slits of the aluminum wiring layer on the glass substrate are for visual inspection and an insulating layer having a thickness of 30 μm may be formed between the wiring layer and the semiconductor chips. In this structure, fixation of the semiconductor chips to the glass substrate may not be secured and the semiconductor chips may be taken off from the glass substrate. From the study, it has also been found that, if semiconductor chips are fixed not through a wiring layer but directly to a glass substrate with adhesive, the glass substrate may be broken due to the difference in the thermal expansion coefficient between the adhesive and the glass and further the semiconductor chips may be taken off.

Based on these findings, the present inventors have concluded that, in the structure for fixing the circuit board of the semiconductors to the glass substrate in the housing by using adhesive, the circuit board can be firmly fixed to the glass substrate by forming the aluminum thin film with a special structure on the glass substrate.

SUMMARY OF THE INVENTION

In view of the above-noted problems, the present invention provides a structure and method capable of firmly fixing a circuit board of a semiconductor to a glass substrate in a housing of a fluorescent display device, in which the circuit board having an anode serving as a light emitting display unit is fixed to the inner surface of the glass substrate.

In accordance with a first aspect of the present invention, there is provided a fluorescent display device which includes a housing having a glass substrate and a circuit board adhered to the inner surface of the glass substrate of the housing. The circuit board is provided with an anode formed of multiple anode conductors, control elements for controlling the anode conductors and a phosphor layer formed on the anode conductors. The fluorescent display further includes an electron source formed above the anode in the housing, from which electrons are bombarded to the phosphor layer corresponding to the anode conductors selected by the control elements so that a desired display can obtained. An aluminum thin film with the aluminum area ratio ranging from 30 to 60% is formed on the inner surface of the glass substrate and the circuit board is fixed to the aluminum thin film via a die-bond material.

Preferably, the aluminum area ratio of the aluminum thin film is within the range between 40 and 50%.

The aluminum thin film on the inner surface of the glass substrate may be formed larger than the circuit board. Further, preferably, an insulating film with an opening smaller than the aluminum thin film and larger than the circuit board is preferably formed on the top surface of the aluminum thin film, and the circuit board is fixed to the aluminum thin film formed in the opening of the insulating layer via the die-bond material.

In accordance with a second aspect of the present invention, there is provided a method for manufacturing a fluorescent display device.

The fluorescent display device includes a housing having a glass substrate; a circuit board adhered to the inner surface of the glass substrate of the housing, the circuit board being provided with an anode formed of multiple anode conductors, control elements for controlling the anode conductors and a phosphor layer formed on the anode conductors.

The fluorescent display device further includes an electron source formed above the anode in the housing, from which electrons are bombarded to the phosphor layer corresponding to the anode conductors selected by the control elements so that a desired display can be obtained.

The method includes steps of forming an aluminum thin film with the aluminum area ratio within a range from 30 to 60% on the inner surface of the glass substrate; printing a die-bond paste of a stripe pattern on the aluminum thin film; evenly spreading the die-bond paste between the circuit board and the aluminum thin film by pressing the die-bond paste with the circuit board mounted thereon; and curing the glass substrate thereby fixing the circuit board thereto.

In accordance with the fluorescent display device of the present invention, the aluminum thin film with the aluminum area ratio within a range from 30 to 60%, preferably, 40 to 50% is formed on the inner surface of the glass substrate of the housing and the circuit board is fixed to the glass substrate via the die-bond material prepared by curing the die-bond paste. Therefore, optimal fixation strength between the circuit board and the glass substrate is obtained and defects such as breaking of the glass substrate or peeling off of the circuit board are prevented. Further, since there is no insulating layer between the circuit board and the aluminum thin film or glass substrate, a stable adhesion between the die-bond material and the aluminum thin film or between the glass substrate and the semiconductor substrate is obtained.

In accordance with the method for manufacturing the fluorescent display device of the present invention, the aluminum thin film with the aluminum area ratio within a range from 30 to 60%, preferably, 40 to 50% is formed on the inner surface of the glass substrate of the housing and the die-bond paste of a stripe pattern is printed thereon and then pressed downward by the circuit board and sintered. Therefore, the die-bond paste is evenly spread between the circuit board and the aluminum thin film is sintered so that the circuit board can be firmly fixed to the glass substrate with optimal strength.

BRIEF DESCRIPTION OF THE DRAWINGS

The objects and features of the present invention will become apparent from the following description of embodiments given in conjunction with the accompanying drawings, in which:

FIG. 5 is a table showing a result of a step impact test on the fluorescent display device;

DETAILED DESCRIPTION OF THE EMBODIMENTS

The embodiments of the present invention will be described with reference to the accompanying drawings which form a part hereof.

(1) Structure

Figure 1:
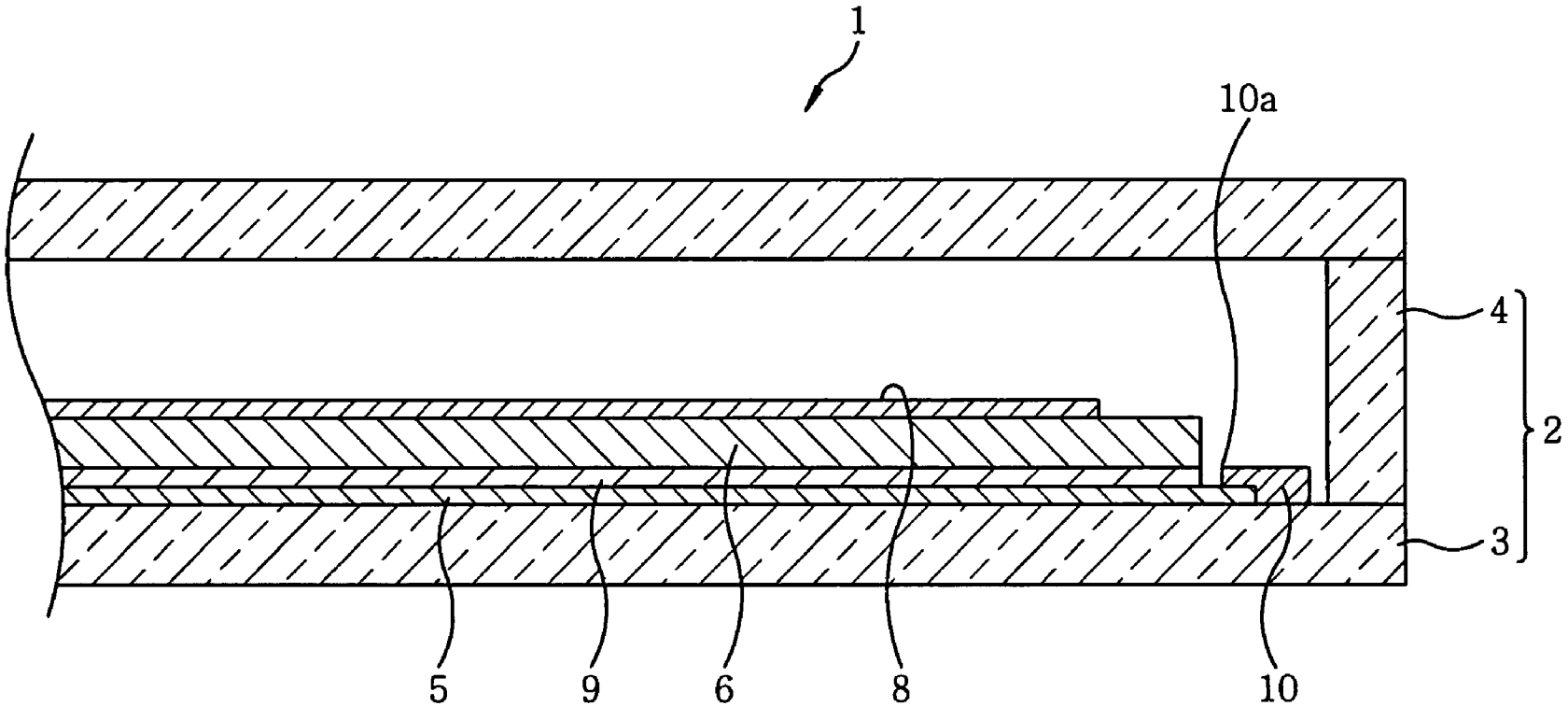
FIG. 1 is a cross-sectional view of a fluorescent display device in accordance with a first embodiment.

As shown in FIG. 1, a fluorescent display device 1 has a housing 2 of a box shape which is maintained at a high level of vacuum state. The housing 2 includes an insulating glass substrate 3 and a lid-shaped casing 4 whose bottom is opened and which is sealed to the inner surface of the glass substrate 3, the casing being formed by assembling glass plates.

An aluminum thin film 5 is formed on an inner surface of the glass substrate 3 in the housing 2 as shown in FIG. 1. The aluminum thin film 5 is formed so that a circuit board 6 can be rigidly fixed to the glass substrate 3 by secure adhesive strength when it is attached with die-bond paste as will be described below. The following conditions are required for the structure of the aluminum thin film 5 in order to achieve this goal.

Figure 2A:
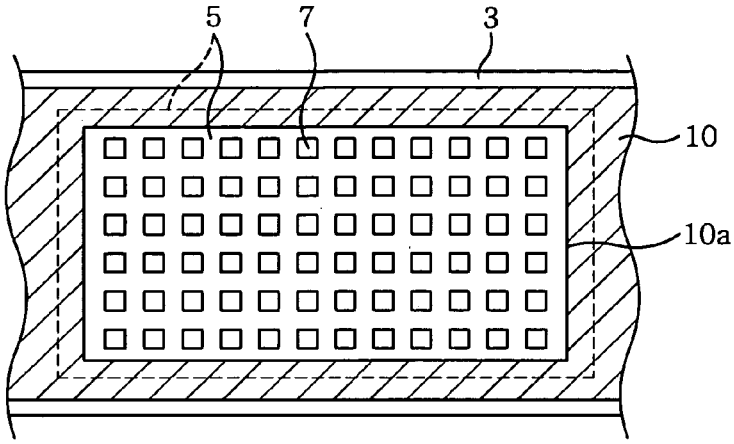
FIGS. 2A to 2C are plane views of a glass substrate before a circuit board is attached thereto in the manufacturing process of the fluorescent display device.
Figure 2B:
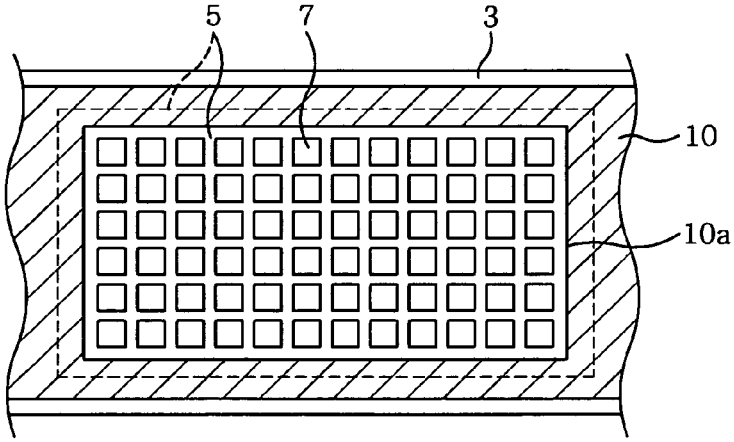
Figure 2C:
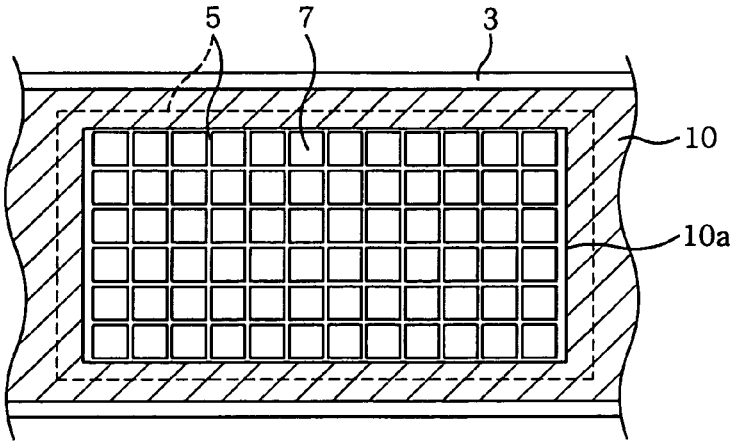

As shown in FIGS. 2A to 2C, the aluminum thin film 5 is provided with multiple openings 7, i.e. holes where the aluminum thin film 5 is not formed, of a same shape, e.g., the square-shaped openings 7 arranged in a grid pattern. Further, an aluminum area ratio, i.e. a ratio of an area where aluminum is coated to a total area of the aluminum thin film 5, is required to be set within a range between 30 and 60%. The aluminum area ratio of the examples in FIGS. 2A to 2C is respectively 75%, 50% and 30%. Therefore, the example shown in FIG. 2A is not an example of the embodiment of the present invention, whereas the examples of FIGS. 2B and 2C are included in the embodiment of the present invention. It has been found from the experiment that the conditions on the aluminum area ratio are necessary to prevent the circuit board 6 from peeling off, which will be described later in detail.

Further, a frame-shaped insulating layer 10 with an opening 10*a* is formed at a peripheral portion of the aluminum thin film 5 on which the circuit board 6 is mounted. The opening 10*a* is useful to determine the location where the circuit board 6 is positioned, while the insulating layer 10 insulates other members and serves as a light blocking member that blocks light from the outside. The insulating layer 10 can be formed by curing paste including low-melting glass containing a black pigment.

As shown in FIG. 1, the circuit board 6 is mounted on the aluminum thin film 5 via a die-bond material 9 applied as adhesive.

The circuit board 6 is formed of a rectangular silicon wafer and provided with an anode serving as a light emitting display unit on its surface. The anode includes multiple anode conductors arranged in a matrix form on a top surface of the circuit board 6, control elements such as switching units each of which is formed at an anode conductor to switch on/off the anode conductor and a phosphor layer 8 which covers the anode conductors.

The die-bond paste used for the die-bond material 9 includes conductive metal particles such as Ag, gelling agent and octanediol. The die-bond paste fills in the openings 7 of the aluminum thin film 5 which are arranged in a grid pattern and forms a film having a uniform thickness on the aluminum thin film 5, so that the circuit board 6 can be securely fixed to the glass substrate 3.

Although not shown, an electron source is disposed above the anode of the circuit board 6 inside the housing 2. A filament type electron source may be used. Otherwise, an electron source of a plate shape may be formed on the inner surface of the casing 4 to face the circuit board 6.

With such a configuration, if a desired anode conductor is selected by applying a display signal to the control elements of the control circuit in the circuit board 6 and then electrons from the electron source are bombarded to the phosphor layer 8 corresponding to the desired anode conductor, the luminous part of the phosphor layer 8 selected as a pixel emits light, so that a desired display can be obtained.

(2) Manufacturing Process

Hereinafter, the manufacturing process of the fluorescent display device 1 in accordance with the embodiment will be described focusing on the process for attaching the circuit board 6.

Figure 3A:
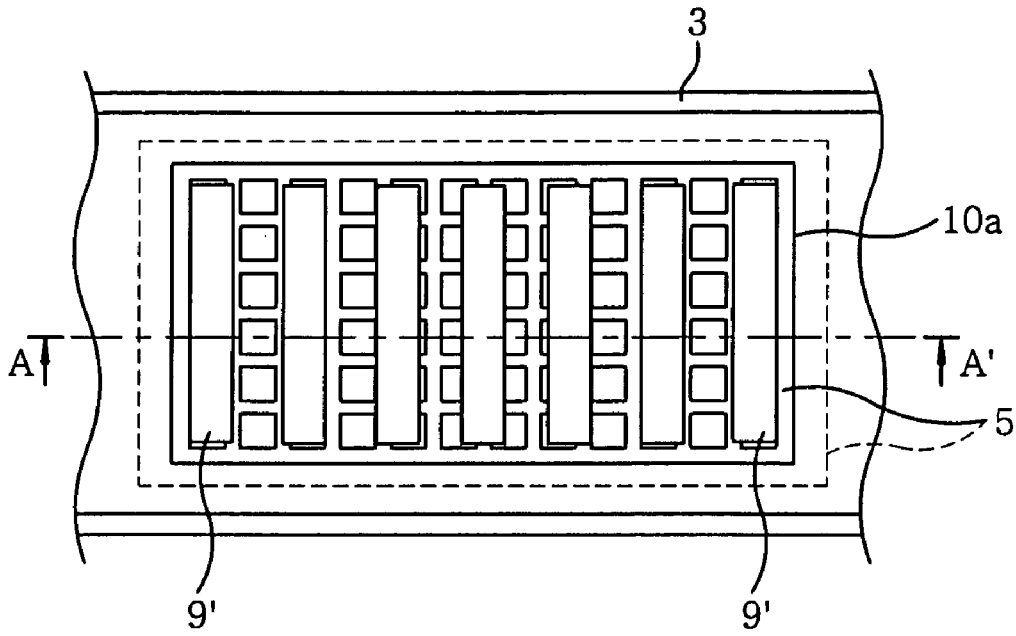
FIGS. 3A and 3B present a plan view for explaining the manufacturing process of the fluorescent display device and a cross-sectional view taken along the line A-A' of FIG. 3A, respectively.

As shown in FIG. 3A, the aluminum thin film 5 is formed on the glass substrate 3 with the aluminum area ratio within a range from 30 to 60%. The die-bond paste 9' is formed on the aluminum thin film 5 and glass substrate 3 in a predetermined pattern by printing. Herein, the die-bond material 9 has a pattern of spaced parallel stripes following the grid pattern of the aluminum thin film 5.

Figure 3B:
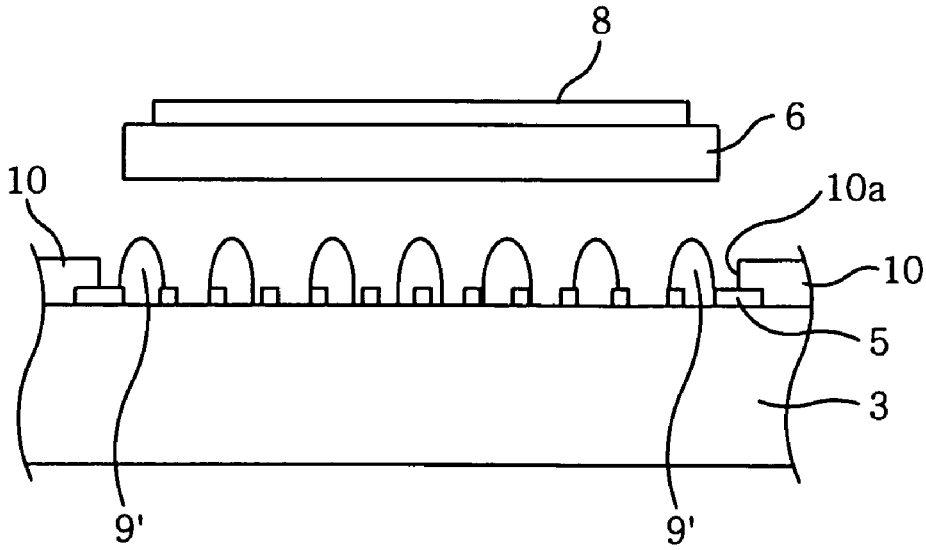

As shown in FIG. 3B, the circuit board 6 having the phosphor layer 8 is transferred above the die-bond paste 9' of a stripe pattern and its location is determined. The anode conductors in the matrix form and their control elements are not shown in FIG. 3B.

Figure 4A:
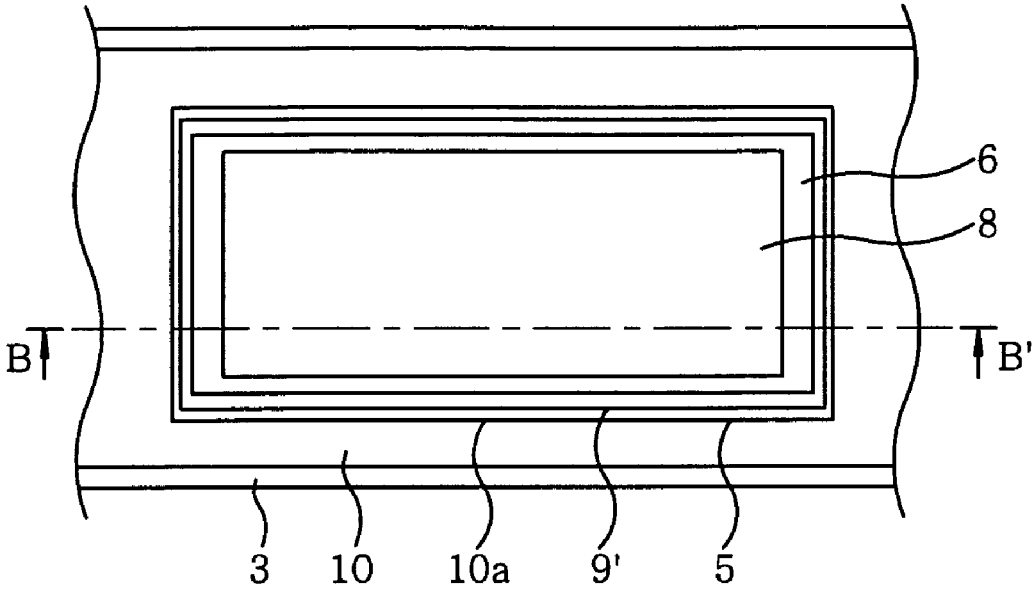
FIGS. 4A and 4B provide a plan view for explaining the manufacturing process of the fluorescent display device and a cross-sectional view taken along the line B-B' of FIG. 4A, respectively.
Figure 4B:
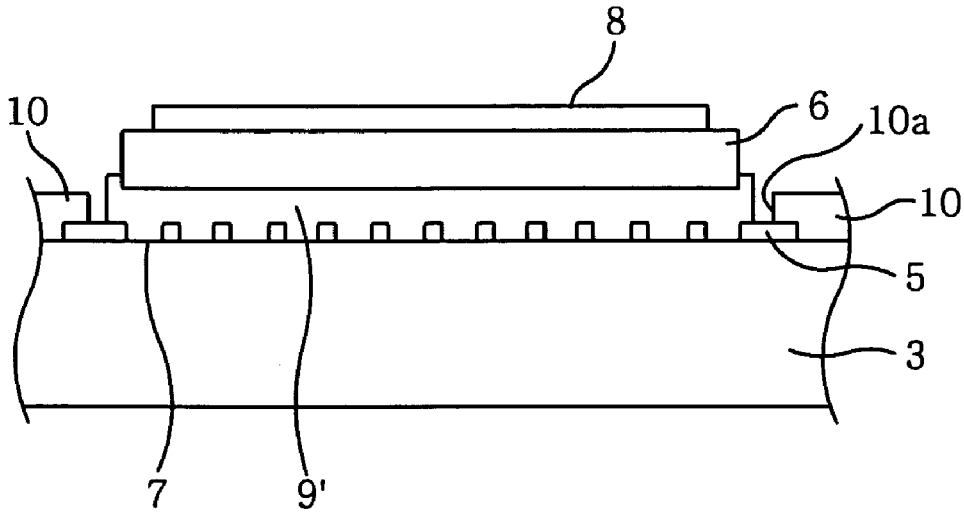

As shown in FIGS. 4A and 4B, when the circuit board 6 is mounted on the glass substrate 3 by uniformly pressing the die-bond paste 9' downward, the die-bond paste 9' of a stripe pattern is pressed to be evenly spread between the circuit board 6 and the glass substrate 3. The die-bond paste 9' fills in the openings 7 of the aluminum thin film 5 in a grid pattern and forms a film having a uniform thickness all over the aluminum thin film 5. Therefore, the die-bond paste 9' is uniformly applied between the circuit board 6 and the glass substrate 3.

In the actual manufacturing process of the fluorescent display device 1 with the circuit board 6, a large glass is cut down to multiple glass substrates 3 of a component size used in the fluorescent display device 1 and the die-bond paste 9' for adhering the circuit board 6 to the glass substrate 3 is then coated on each glass substrate 3 one by one. However, this operation takes a long time with a dispenser so it is preferable to employ a printing method. If a conventional printing method is used to form a uniform layer of the die-bond material 9 between the circuit board 6 and the glass substrate 3 (aluminum thin film 5), controlling the discharge amount of the paste 9' is difficult and therefore the conventional printing method is not preferable. However, in accordance with the embodiment, the die-bond paste 9' of a stripe pattern is quickly printed on the aluminum thin film 5 where the circuit board 6 will be adhered by printing and then pressed by the circuit board 6 so that a uniform layer of the die-bond material 9 can be easily formed between the circuit board 6 and the glass substrate 3.

Then, the glass substrate 3 is sintered at a temperature within a range from 480 to 500° C. in the atmosphere and therefore the die-bond paste 9' is solidified, thereby fixing the circuit board 6 to the glass substrate 3.

Although not shown, other necessary internal components are then formed and the casing 4 is sealed at the top surface of the glass substrate 3. If the inside is evacuated and then sealed by curing, the fluorescent display device 1 of the embodiment is completed.

(3) Effects

The aluminum area ratio of the aluminum thin film 5 is preferably within the range from 30 to 60% as described above. An experiment to find the range of the aluminum area ratio necessary to prevent the circuit board 6 from peeling off will be described hereinafter.

Figure 6:
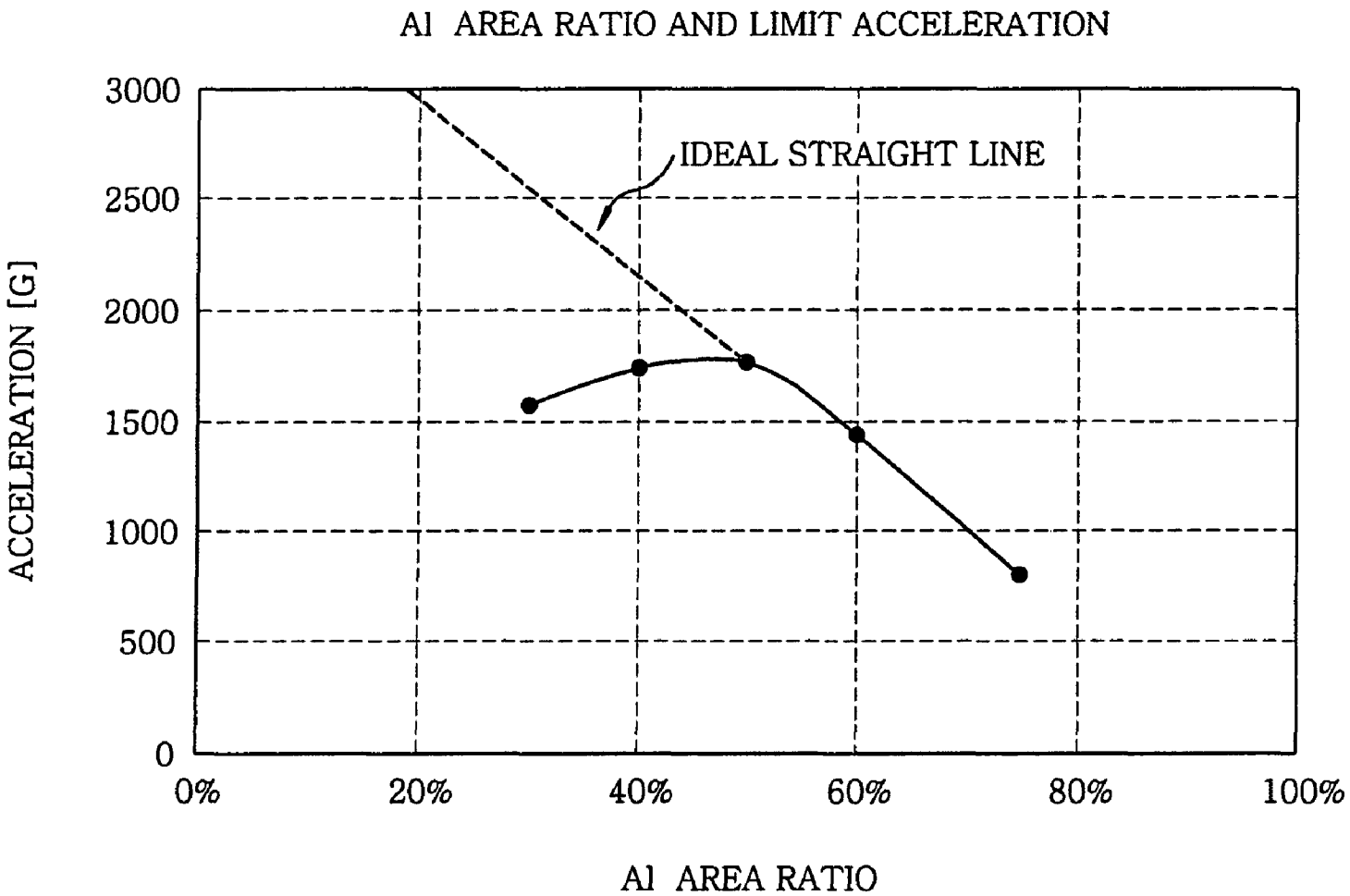
FIG. 6 is a graph showing a relationship between the aluminum area ratio and the limit acceleration obtained from the test result of the fluorescent display device shown in FIG. 5.
Figure 7:
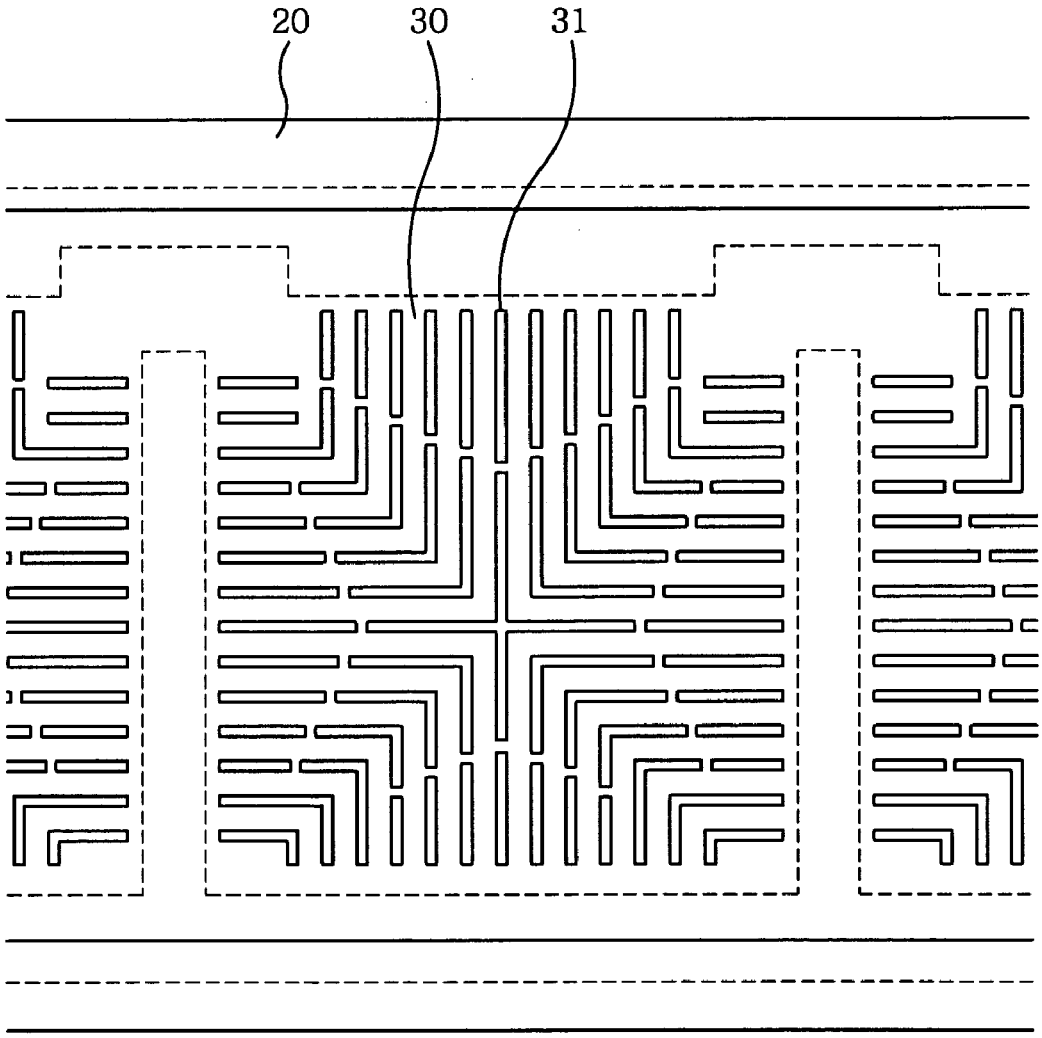
FIG. 7 (PRIOR ART)
FIG. 7 is a plan view of a glass substrate of a fluorescent display device disclosed in prior art.
Figure 8:
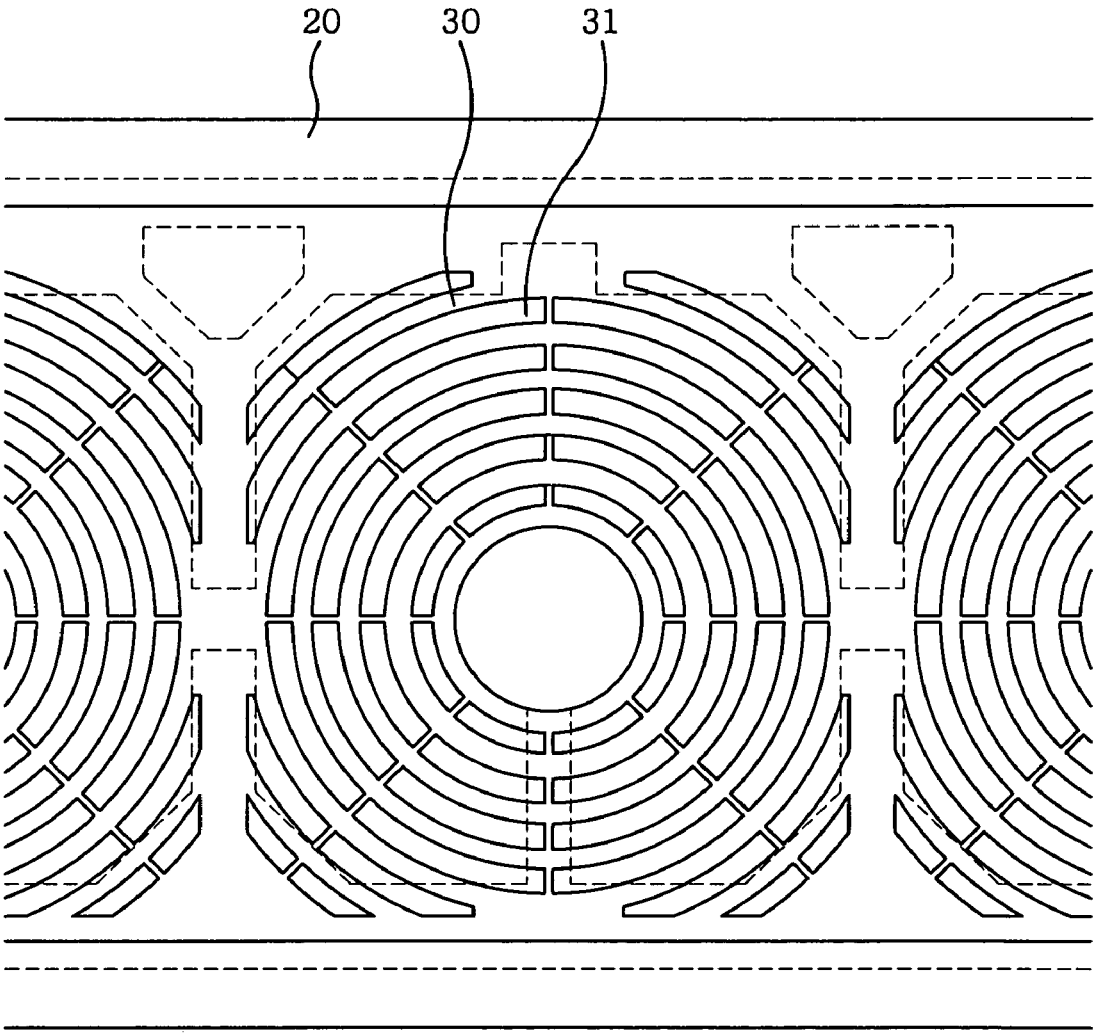
FIG. 8 (PRIOR ART)
FIG. 8 is a plan view of a glass substrate of the fluorescent display device disclosed in prior art.
Figure 9A:
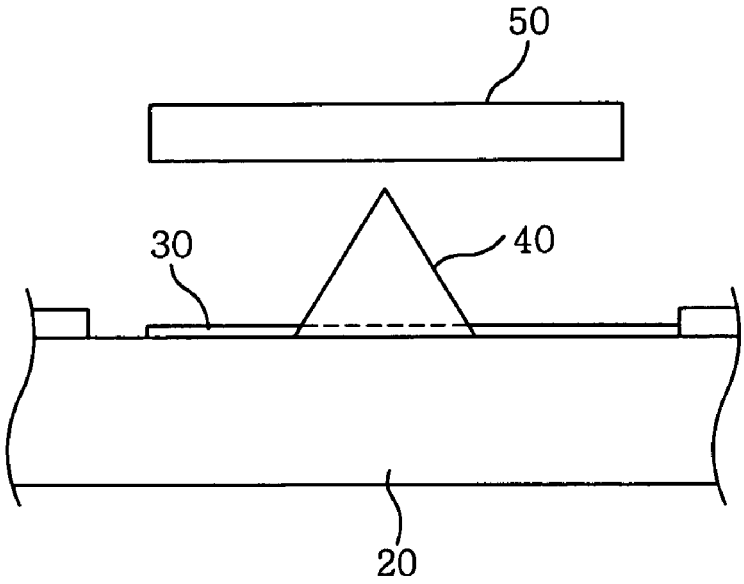
FIG. 9A (PRIOR ART)
FIGS. 9A and 9B are drawings for describing the process of mounting a semiconductor chip on the glass substrate of the fluorescent display device disclosed in prior art.
Figure 9B:
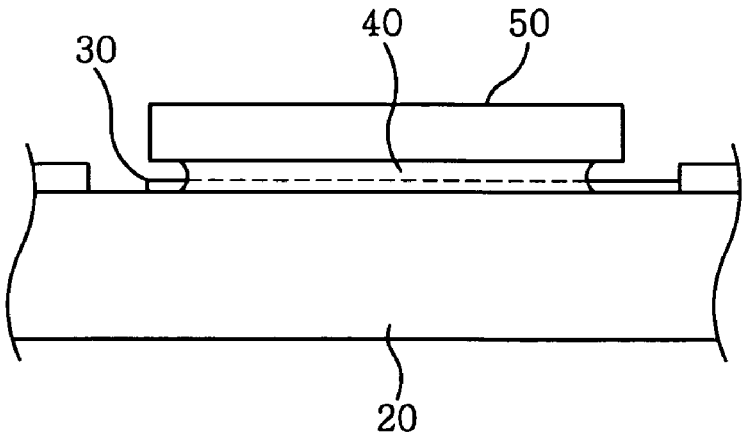
FIG. 9B (PRIOR ART)

In the experiment, multiple fluorescent display devices 1 having the configuration of the fluorescent display device 1 described above except for the aluminum area ratio of the aluminum thin film 5 were prepared as test samples. To be specific, the aluminum area ratio of each aluminum thin film 5 was 30%, 40%, 50%, 60% and 75% i.e. five types of the fluorescent display devices were prepared, and five samples for each type were provided as shown in FIGS. 5 and 6.

The experiment was a step impact test to observe whether or not peeling off of the circuit board 6 occurred by impact of collision caused by predetermined acceleration when a sample fluorescent display device 1 was installed on the stage of the test apparatus such that its circuit board 6 could face downward; the stage was elevated and maintained at a predetermined position; and the fluorescent display device 1 was released to fall down by loosening the fixing member.

The impact test on one fluorescent display device 1 was performed for every 100 G increase of the acceleration from 600 G to 2000 G and the acceleration when the circuit board 6 was peeled off was recorded. Since five samples for each type of the fluorescent display devices 1 were prepared, five limit acceleration data for each type of the fluorescent display devices 1 were originally obtained as shown in FIG. 5. In order to check the overall tendency, the graph shown in FIG. 6 was obtained by averaging five data for each type of the fluorescent display devices 1.

As a result of the experiment, the average acceleration is over 1400 G when the aluminum area ratio of the aluminum thin film 5 is within the range from 30 to 60%, which allows enough strength for practical use. For example, in case of fluorescent display devices 1 for vehicle application to which big impact is irregularly repeated, the range from 30 to 60% is required to obtain strength necessary for practical application. The average acceleration is over 1700 G in the range from 40 to 50%, which is more preferable.

According to the result of the experiment, in the aluminum area ratio of the aluminum thin film 5 within the range from 50 to 75%, fixation strength decreases as the aluminum area ratio of the aluminum thin film 5 increases, whereas fixation strength increases as the aluminum area ratio of the aluminum thin film 5 decreases. In contrast, in the aluminum area ratio of the aluminum thin film 5 less than 50%, fixation strength decreases as the aluminum area ratio of the aluminum thin film 5 decreases, deviating from the tendency as indicated by a broken line in FIG. 6. The reason seems to be that fine cracks are developed in the glass substrate 3 and the die-bond paste 9' when fixation strength becomes excessively increased in the manufacturing process and then the fixation strength drops when the test sample is completely formed.

The openings of a circular or elliptical shape, a polygonal shape or the like may provide the same effects as those of the square-shaped openings of the embodiment shown in FIG. 2. Further, openings of different shapes may be repeatedly formed, which can also provide the same effects as those of the embodiment.

While the invention has been shown and described with respect to the preferred embodiments, it will be understood by those skilled in the art that various changes and modifications may be made without departing from the spirit and scope of the invention as defined in the following claims.

What is claimed is:

1. A fluorescent display device for use in a vehicle comprising:

a housing having a glass substrate;

a circuit board adhered to an inner surface of the glass substrate of the housing, the circuit board including a semiconductor substrate, an anode formed of multiple anode conductors, control elements for controlling the anode conductors, and a phosphor layer formed on the anode conductors, wherein the anode and the phosphor layer are formed on the semiconductor substrate; and an electron source formed above the anode in the housing, from which electrons are bombarded to the phosphor layer corresponding to the anode conductors selected by the control elements so that a desired display can be obtained, wherein an aluminum thin film with the aluminum area ratio within a range from 30 to 60% is formed on the inner surface of the glass substrate such that the circuit board can be prevented from peeling off, and the circuit board is fixed to the aluminum thin film via a die-bond material, wherein the aluminum thin film has a peripheral portion which is not covered with the circuit board; an insulating film is formed on the top surface of the aluminum thin film, the insulating film covering the peripheral portion of the aluminum thin film and having an opening through which the circuit board is exposed, and wherein the insulating film is not covered with the circuit board and a portion of the aluminum thin film on the inner surface of the glass substrate is exposed between the circuit board and the insulating film.

2. The fluorescent display device of claim 1, wherein the aluminum area ratio of the aluminum thin film is within the range from 40 to 50%.

3. A method for manufacturing a fluorescent display device for use in a vehicle including a housing having a glass substrate; a circuit board adhered to the inner surface of the glass substrate of the housing, the circuit board containing a semiconductor substrate, an anode formed of multiple anode conductors, control elements for controlling the anode conductors, and a phosphor layer formed on the anode conductors, wherein the anode and the phosphor layer are formed on the semiconductor substrate; and an electron source formed above the anode in the housing, from which electrons are bombarded to the phosphor layer corresponding to the anode conductors selected by the control elements so that a desired display can obtained, the method comprising the steps of:

forming an aluminum thin film with the aluminum area ratio within a range from 30 to 60% on the inner surface of the glass substrate such that the circuit board can be prevented from peeling off, the aluminum having a peripheral portion which is not covered with the circuit board;

forming an insulating film with an opening through which the circuit board is exposed on the top surface of the aluminum thin film, the insulating film covering the peripheral portion of the aluminum thin film;

forming a die-bond paste of a stripe pattern in which parallel stripes are formed with a space between neighboring stripes on the aluminum thin film formed in the opening of the insulating film;

evenly spreading the die-bond paste between the circuit board and the aluminum thin film by pressing the die-bond paste with the circuit board mounted thereon; and sintering the glass substrate thereby fixing the circuit board thereto.

* * * * *